US011953005B2

(12) United States Patent
Sasano et al.

(10) Patent No.: US 11,953,005 B2
(45) Date of Patent: Apr. 9, 2024

(54) COMPRESSOR HAVING ORBITING SCROLL SUPPLY HOLE TO LUBRICATE THRUST SURFACE

(71) Applicant: Mitsubishi Electric Corporation, Tokyo (JP)

(72) Inventors: Wataru Sasano, Tokyo (JP); Koji Masumoto, Tokyo (JP); Yuji Takamura, Tokyo (JP); Kohei Tatsuwaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 58 days.

(21) Appl. No.: 17/777,694

(22) PCT Filed: Jan. 22, 2020

(86) PCT No.: PCT/JP2020/002072
§ 371 (c)(1),
(2) Date: May 18, 2022

(87) PCT Pub. No.: WO2021/149180
PCT Pub. Date: Jul. 29, 2021

(65) Prior Publication Data

US 2022/0412352 A1 Dec. 29, 2022

(51) Int. Cl.
*F04C 18/02* (2006.01)
*F04B 39/02* (2006.01)
(Continued)

(52) U.S. Cl.
CPC ..... *F04C 18/0253* (2013.01); *F04C 18/0215* (2013.01); *F04C 28/26* (2013.01);
(Continued)

(58) Field of Classification Search
CPC .. F04C 18/0253; F04C 18/0215; F04C 28/26; F04C 29/02; F04C 29/025; F04C 29/028;
(Continued)

(56) References Cited

U.S. PATENT DOCUMENTS 4,637,786 A * 1/1987 Matoba ..... F01C 21/04 464/7
5,395,224 A * 3/1995 Caillat ..... F04C 18/0215 418/94
(Continued)

FOREIGN PATENT DOCUMENTS

CN 205001199 U * 1/2016
JP H02-005787 A 1/1990
(Continued)

OTHER PUBLICATIONS

English Machine translation of CN20501199U (Year: 2016).*
(Continued)

*Primary Examiner* — Dominick L Plakkoottam
*Assistant Examiner* — Paul W Thiede
(74) *Attorney, Agent, or Firm* — POSZ LAW GROUP, PLC

(57) ABSTRACT

A compressor includes: a shell forming an outer portion thereof and having lower part in which an oil pan is formed to store oil; a motor provided in the shell; a compression unit provided in the shell to compress a working gas when being driven by the motor; a frame fixed to the shell and supporting the compression unit; a shaft supported by the frame, connecting the motor and the compression unit, provided to transmit a turning force of the motor to the compression unit, and including an oil passage; and an oil pump provided at lower part of the shaft to draw oil from the pan and supply the oil into the oil passage. The pump includes a bypass valve that is opened, when a pressure of oil flowing in the
(Continued)

oil passage is higher than a threshold pressure, to return part of the oil to the pan.

7 Claims, 14 Drawing Sheets

(51) Int. Cl.
*F04C 23/00* (2006.01)
*F04C 28/26* (2006.01)
*F04C 29/02* (2006.01)

(52) U.S. Cl.
CPC ..... *F04C 29/02* (2013.01); *F04C 29/025* (2013.01); *F04C 29/028* (2013.01); *F04B 39/02* (2013.01); *F04B 39/0246* (2013.01); *F04B 39/0261* (2013.01); *F04B 39/0284* (2013.01); *F04C 23/008* (2013.01); *F04C 2240/603* (2013.01); *F04C 2270/205* (2013.01)

(58) Field of Classification Search
CPC ..... F04C 23/008; F04C 2240/603; F04C 2270/205; F04C 18/02; F04B 39/02; F04B 39/0246; F04B 39/0261; F04B 39/0284
See application file for complete search history.

(56) References Cited

U.S. PATENT DOCUMENTS

| | | | | |
|---|---|---|---|---|
| 2017/0089341 | A1* | 3/2017 | Takamura | F04C 23/008 |
| 2018/0306189 | A1* | 10/2018 | De Bontridder | F04C 28/28 |
| 2019/0195224 | A1* | 6/2019 | Matsui | F04C 29/023 |

FOREIGN PATENT DOCUMENTS

| | | | |
|---|---|---|---|
| JP | H04-350383 | A | 12/1992 |
| JP | 2000-213476 | A | 8/2000 |
| JP | 65418272 | B2 * | 6/2019 |
| WO | 2015/104863 | A1 | 7/2015 |
| WO | 2015/177851 | A1 | 11/2015 |
| WO | 2017/158809 | A1 | 9/2017 |
| WO | 2017/169596 | A1 | 10/2017 |

OTHER PUBLICATIONS

International Search Report of the International Search Authority dated Mar. 17, 2020 in corresponding International Application No. PCT/JP2020/002072 (and English machine translation).
Office Action dated Feb. 21, 2023 issued in corresponding JP Patent Application No. 2021-572183 (and English translation).
Office Action dated Jul. 4, 2023 issued in corresponding Japanese Patent Application No. 2021-572183 (and English translation).

* cited by examiner

COMPRESSOR HAVING ORBITING SCROLL SUPPLY HOLE TO LUBRICATE THRUST SURFACE

CROSS REFERENCE TO RELATED APPLICATIONS

This application is a U.S. national stage application of PCT/JP2020/002072 filed on Jan. 22, 2020, the contents of which are incorporated herein by reference.

TECHNICAL FIELD

The present disclosure relates to a compressor that compresses working gas.

BACKGROUND ART

In the past, scroll compressors for use in refrigeration, air conditioning, or other uses have been known as compressors that compress a working gas. In such a scroll compressor, a compression unit that is a combination of a fixed scroll and an orbiting scroll that include respective scroll laps compresses a working gas such as refrigerant when the orbiting scroll is revolved. In the compressor, in order that the orbiting scroll be smoothly revolved, a shaft supported by a main bearing and a sub bearing is rotated by a motor.

Patent Literature 1 discloses a scroll compressor including a pump unit that is a positive-displacement pump whose volume is constant, such as a trochoid pump. In Patent Literature 1, oil is drawn up by the pump unit, from an oil storage space provided at lower part of a shell and is supplied to bearings, a compression unit, and other part. With the above feature, the technique of Patent Literature 1 is intended to protect the bearings and the compression unit from abrasion.

CITATION LIST

Patent Literature

Patent Literature 1: Japanese Unexamined Patent Application Publication No. 4-350383

SUMMARY OF INVENTION

Technical Problem

However, the positive-displacement pump whose volume is constant is used in the scrod compressor disclosed in Patent Literature 1. The amount of oil drawn up by the positive-displacement pump per unit time depends on the rotation speed of the compression unit because of the structure of the positive-displacement pump. In Patent Literature 1, since the positive-displacement pump whose volume is constant is used, the amount of supply of oil is increased in a high-speed operation in which the rotation speed of the compression unit is high. This may increase the amount of oil loss.

The present disclosure is applied to solve the above problem, and relates to a compressor that reduces an increase in the amount of oil loss in a high-speed operation of a compression unit.

Solution to Problem

A compressor according to an embodiment of the present disclosure includes: a shell forming an outer portion of the compressor and having lower part in which an oil pan is formed, the oil pan being configured to store oil; a motor provided in the shell; a compression unit provided in the shell and configured to compress a working gas when being driven by the motor; a frame fixed to the shell and supporting the compression unit; a shaft supported by the frame and connecting the motor and the compression unit, the shaft being configured to transmit a turning force of the motor to the compression unit, and including an oil passage through which oil flows; and an oil pump provided at lower part of the shaft, and configured to draw oil from the oil pan and supply the oil into the oil passage. The pump includes a bypass valve configured to be opened, when a pressure of oil flowing in the oil passage is higher than a threshold pressure, to return part of the oil to the oil pan.

Advantageous Effects of Invention

According to the embodiment of the present disclosure, the oil pump includes the bypass valve that is opened, when the pressure of oil flowing in the oil passage is higher than a threshold pressure, to return part of the oil to the oil pan. The bypass valve of the oil pump is opened when the pressure of oil flowing in the oil passage in a high-speed operation in which the rotation speed of the compression unit is high is raised. Thus, part of the oil is returned to the oil pan. Therefore, it is possible to reduce an increase in the amount of oil supply in the high-speed operation of the compression unit. Accordingly, the compressor is capable of reducing an increase in oil loss in the high-speed operation of the compression unit.

DESCRIPTION OF EMBODIMENTS

Compressors according to embodiments of the present disclosure will be described with reference to the drawings.

The present disclosure is not limited to the embodiments as described below. The relationships in size between components and structural elements in figures including FIG. 1 that will be referred to below may differ from those of actual ones. In the following descriptions, in order that the present disclosure be easily understood, terms related to directions are used as appropriate. However, the terms are used only for explanation of the present disclosure, but do not limit the present disclosure. As examples of the terms, "upper", "lower", "right", "left", "rear", etc., are present. Also, it should be noted that in some of the figures, hatching in sectional views is omitted.

Embodiment 1

Figure 1:
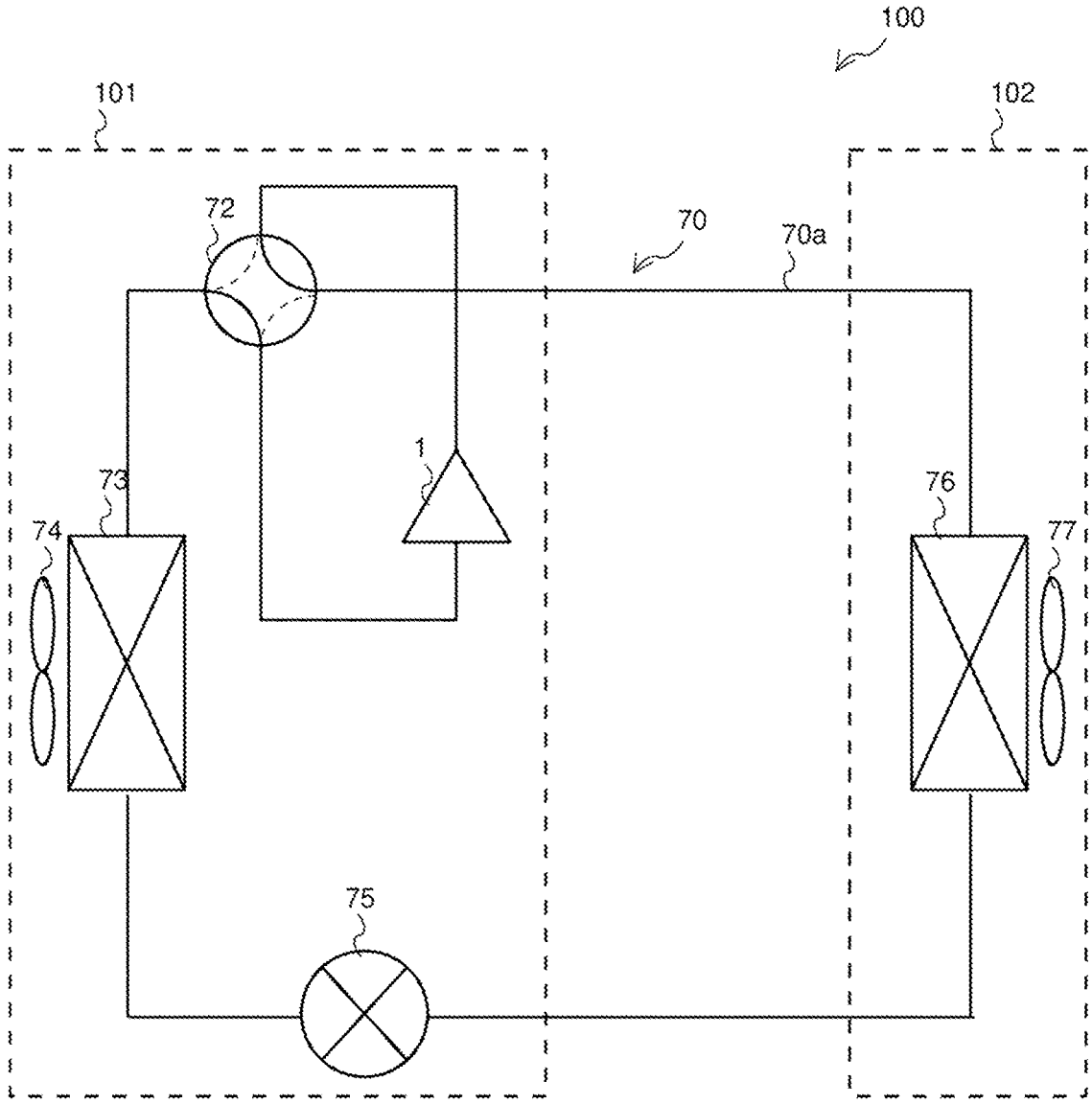
FIG. 1 is a circuit diagram of an air-conditioning apparatus according to Embodiment 1.

FIG. 1 is a circuit diagram of an air-conditioning apparatus 100 according to Embodiment 1. As illustrated in FIG. 1, the air-conditioning apparatus 100 is an apparatus that conditions air in an indoor space. The air-conditioning apparatus 100 includes an outdoor unit 101 and an indoor unit 102 that is capable of communicating with the outdoor unit 101. The outdoor unit 101 includes a compressor 1, a flow switching device 72, an outdoor heat exchanger 73, an outdoor fan 74, and an expansion unit 75. The indoor unit 102 includes an indoor heat exchanger 76 and an indoor fan 77.

The compressor 1, the flow switching device 72, the outdoor heat exchanger 73, the expansion unit 75, and the indoor heat exchanger 76 are connected by refrigerant pipes 70*a*, whereby a refrigerant circuit 70 is formed. In the refrigerant circuit 70, refrigerant that is a working gas flows. The compressor 1 sucks low-temperature and low-pressure refrigerant, compresses the sucked refrigerant into high-temperature and high-pressure refrigerant to change it into high-temperature and high-pressure refrigerant, and discharges the high-temperature and high-pressure refrigerant. The flow switching device 72 changes the flow direction of refrigerant in the refrigerant circuit 70 in a switching manner. The flow switching device 72 is, for example, a four-way valve. For example, the outdoor heat exchanger 73 causes heat exchange to be performed, for example, between outdoor air and refrigerant. The outdoor heat exchanger 73 operates as a condenser in a cooling operation and operates as an evaporator in a heating operation.

The outdoor fan 74 is a device that sends outdoor air to the outdoor heat exchanger 73. The expansion unit 75 is a pressure reducing valve or an expansion valve that decompresses and expands refrigerant. The expansion unit 75 is, for example, an electronic expansion valve whose opening degree is adjusted. The indoor heat exchanger 76 causes heat exchange to be performed, for example, between indoor air and refrigerant. The indoor heat exchanger 76 operates as an evaporator in the cooling operation and operates as a condenser in the heating operation. The indoor fan 77 is a device that sends indoor air to the indoor heat exchanger 76.

(Operation Mode: Cooling Operation)

Next, the operation modes of the air-conditioning apparatus 100 will be described. First of all, the cooling operation will be described. In the cooling operation, the compressor 1 compresses refrigerant sucked into the compressor 1 to change it into high-temperature and high-pressure gas refrigerant and discharges the high-temperature and high-pressure gas refrigerant. The high-temperature and high-pressure gas refrigerant discharged from the compressor 1 passes through the flow switching device 72, flows into the outdoor heat exchanger 73 operating as a condenser, and is condensed by heat exchange with outdoor air sent by the outdoor fan 74 in the outdoor heat exchanger 73 to change into liquid refrigerant. The condensed liquid refrigerant flows into the expansion unit 75 and is expanded and decompressed in the expansion unit 75 to change into low-temperature and low-pressure two-phase gas-liquid refrigerant. The two-phase gas-liquid refrigerant then flows into the indoor heat exchanger 76 operating as an evaporator and is evaporated by heat exchange with indoor air sent by the indoor fan 77 in the indoor heat exchanger 76 to change into low-temperature and low-pressure gas refrigerant. At this time, the indoor air is cooled, and cooling is performed in the indoor space. The evaporated low-temperature and low-pressure gas refrigerant passes through the flow switching device 72 and is sucked into the compressor 1.

(Operation Mode: Heating Operation)

Next, the heating operation will be described. In the heating operation, the compressor 1 compresses refrigerant sucked into the compressor 1 into high-temperature and high-pressure gas refrigerant and discharges the high-temperature and high-pressure gas refrigerant. The high-temperature and high-pressure gas refrigerant discharged from the compressor 1 passes through the flow switching device 72, flows into the indoor heat exchanger 76 operating a condenser, and is condensed by heat exchange with indoor air sent by the indoor fan 77 in the indoor heat exchanger 76 to change into liquid refrigerant. At this time, the indoor air is heated, and heating is performed in the indoor space. The condensed liquid refrigerant flows into the expansion unit 75 and is expanded and decompressed in the expansion unit 75 to change into low-temperature and low-pressure two-phase gas-liquid refrigerant. The two-phase gas-liquid refrigerant then flows into the outdoor heat exchanger 73 operating as an evaporator and is evaporated by heat exchange with outdoor air sent by the outdoor fan 74 in the outdoor heat exchanger 73 to change into low-temperature and low-pressure gas refrigerant. The evaporated low-temperature and low-pressure gas refrigerant passes through the flow switching device 72 and is sucked into the compressor 1.

Next, the compressor 1 will be specifically described. For example, the compressor 1 is used in a refrigeration cycle apparatus for refrigeration or air conditioning, such as a refrigerator, a freezer, the air-conditioning apparatus 100, a refrigeration apparatus, and a hot-water supply apparatus. In Embodiment 1, the compressor 1 for use in the air-conditioning apparatus 100 will be described. The compressor 1 sucks a working gas that circulates in a refrigeration cycle, compresses the sucked working gas to change it into a high-temperature and high-pressure gas, and discharges the high-temperature and high-pressure gas. The compressor 1 is, for example, a hermetic scroll compressor.

Figure 2:
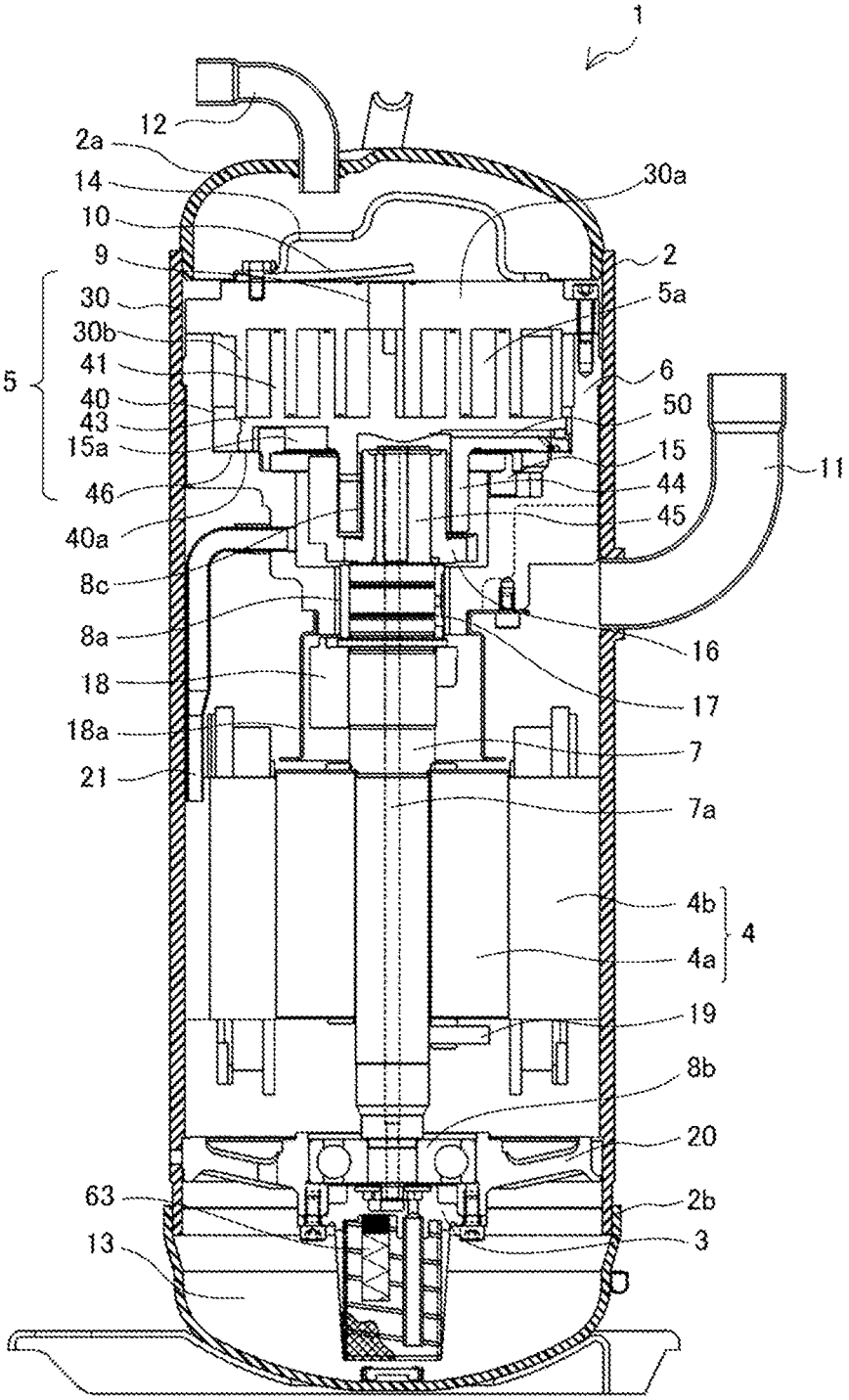
FIG. 2 is a sectional view of a compressor according to Embodiment 1.

FIG. 2 is a sectional view of the compressor 1 according to Embodiment 1. As illustrated in FIG. 2, the compressor 1 includes a shell 2, a frame 6, a sub frame 20, a shaft 7, a main bearing 8*a*, a sub bearing 8*b*, a suction pipe 11, a discharge pipe 12, and a compression unit 5. In addition, the compressor 1 includes an eccentric portion 45, an Oldham ring 15, a slider 16, a sleeve 17, a first balancer 18, a second balancer 19, a discharge valve 10, a muffler 14, an oil pump 3, an oil discharge pipe 21, and a motor 4.

The shell 2 is a hermetic container that forms an outer portion of the compressor 1, and is formed in the shape of a cylinder having a bottom. The shell 2 is provided on a lower shell 2*b*. Upper part of the shell 2 is covered with an upper shell 2*a*, which has a dome shape. The compression unit 5, the motor 4, and other components are housed in the shell 2. The compression unit 5 is provided in an upper region in the shell 2. The motor 4 is provided in a lower region in the shell 2. An oil pan 13 is formed in lower part of the shell 2.

The frame 6 is fixed to the shell 2 and accommodates the compression unit 5. For example, the shaft 7 is rotatably supported by the frame 6, with the main bearing 8*a* interposed between the shaft 7 and the frame 6. The frame 6 is provided above the motor 4 and located between the motor 4 and the compression unit 5. The frame 6 has Oldham grooves 15*a*, which accommodate claws of the Oldham ring 15. The frame 6 has a suction port through which a working gas passes to flow into the compression unit 5.

The sub frame 20 is provided below the motor 4 in the shell 2. The shaft 7 is rotatably supported by the sub frame 20, with the sub bearing 8*b* interposed between the shaft 7 and the sub frame 20. The frame 6 and the sub frame 20 are fixed in the shell 2 and located opposite to each other with respect to the motor 4. The frame 6 and the sub frame 20 are fixed to an inner peripheral surface of the shell 2 by, for example, shrink fitting or welding. The shaft 7 is supported by the frame 6 at the center of the shell 2. The shaft 7 is a rod-shaped crankshaft that extends in an up-down direction, and connects the motor 4 and the compression unit 5. To be more specific, the shaft 7 connects the motor 4 and the compression unit 5 to transmit a rotative force of the motor 4 to the compression unit 5. In the shaft 7, an oil passage 7*a* is formed to allow oil to pass therethrough. The main bearing 8*a* is provided at the center of the frame 6, and upper part of the shaft 7 is rotatably supported by the main bearing 8*a*. The sub bearing 8*b* is provided at the center of the sub frame 20, and lower part of the shaft 7 is rotatably supported by the sub bearing 8*b*.

The suction pipe 11 is connected, at a side of the shell 2, with a low-pressure space in the shell 2 that is provided between the motor 4 and the compression unit 5. Through the suction pipe 11, a low-pressure working gas that flows through the refrigerant pipe 70*a* is sucked into the low-pressure space. The discharge pipe 12 is connected, at the upper part of the shell 2, to a high-pressure space in the shell 2 that is provided above the compression unit 5. Through the discharge pipe 12, a high-pressure working gas compressed by the compression unit 5 is discharged into the refrigerant pipe 70*a*, which is located outside the compressor 1.

The compression unit 5 compresses a working gas sucked through the suction pipe 11 and discharges the compressed working gas into the high-pressure space provided in the upper part of the shell 2. The compression unit 5 includes a fixed scroll 30, an orbiting scroll 40, and a thrust plate 46. The fixed scroll 30 is fixed, at a position located above the orbiting scroll 40, to the shell 2 via the frame 6 by, for example, a bolt (not illustrated). The fixed scroll 30 includes a panel 30*a* and a fixed scroll lap 30*b*. The panel 30*a* is a plate-like member that forms upper part of the fixed scroll 30. The fixed scroll lap 30*b* is a scroll lap that extends downward from a lower surface of the panel 30*a* and that is formed in such a manner as to spiral outward from the center thereof. At the center of the fixed scroll 30, a discharge port 9 is formed as a space into which a compressed high-pressure working gas is discharged.

The orbiting scroll 40 revolves (orbits) relative to the fixed scroll 30. The orbiting scroll 40 includes a boss 44, a base plate 43, and an orbiting scroll lap 41. The boss 44 forms lower part of the orbiting scroll 40 and has a cylindrical shape to accommodate the eccentric portion 45 of the shaft 7. The base plate 43 is a plate-like member that connects the boss 44 and the orbiting scroll lap 41. The orbiting scroll lap 41 is a scroll lap that extends upward from upper part of the boss 44 and that is formed in such a manner as to spiral outward from the center thereof. In lower part of the orbiting scroll 40, Oldham grooves 15*a* are formed to accommodate claws of the Oldham ring 15.

A lower surface of the orbiting scroll 40 is a thrust surface 40*a* that serves as a sliding portion. The fixed scroll 30 and the orbiting scroll 40 are provided in the shell 2 such that fixed scroll lap 30*b* and the orbiting scroll lap 41 are engaged with each other. The fixed scroll lap 30*b* and the orbiting scroll lap 41 are formed to follow an involute curve. The fixed scroll lap 30*b* and the orbiting scroll lap 41 are combined in such a manner as to be engaged with each other, thereby forming a plurality of compression chambers 5*a* between the fixed scroll lap 30*b* and the orbiting scroll lap 41.

Figure 3:
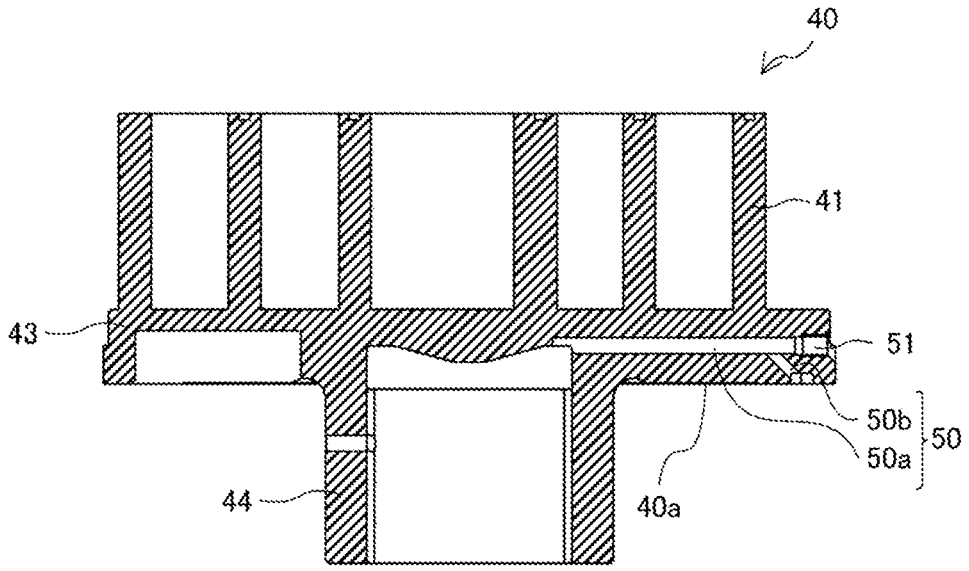
FIG. 3 is a sectional view of an orbiting scroll according to Embodiment 1.
Figure 4:
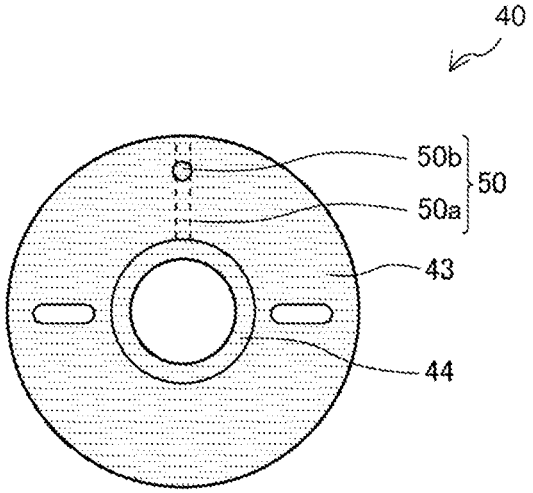
FIG. 4 is a bottom view of the orbiting scroll according to Embodiment 1.

FIG. 3 is a sectional view of the orbiting scroll 40 according to Embodiment 1. FIG. 4 is a bottom view of the orbiting scroll 40 according to Embodiment L As illustrated in FIGS. 3 and 4, a supply hole 50 is formed in base plate 43 of orbiting scroll 40. The supply hole 50 connects the oil passage 7*a* and the thrust surface 40*a*, and is used to supply oil that flows in the oil passage 7*a* to the thrust surface 40*a* through the supply hole 50. The supply hole 50 includes a first hole 50*a* and a second hole 50*b*.

The first hole 50*a* is a hole that extends laterally from upper end part of the oil passage 7*a*, which is formed in the shaft 7 accommodated in the boss 44, It should be noted that an outlet of the first hole 50*a* is covered with a set screw 51. The second hole 50*b* is a hole that extends downward from the first hole 50*a* and that connects the first hole 50*a* and the thrust surface 40*a*. In Embodiment 1, the second hole 50*b* is formed in such a manner as to be inclined outward, but may be formed to extend linearly downward without being inclined.

Figure 5:
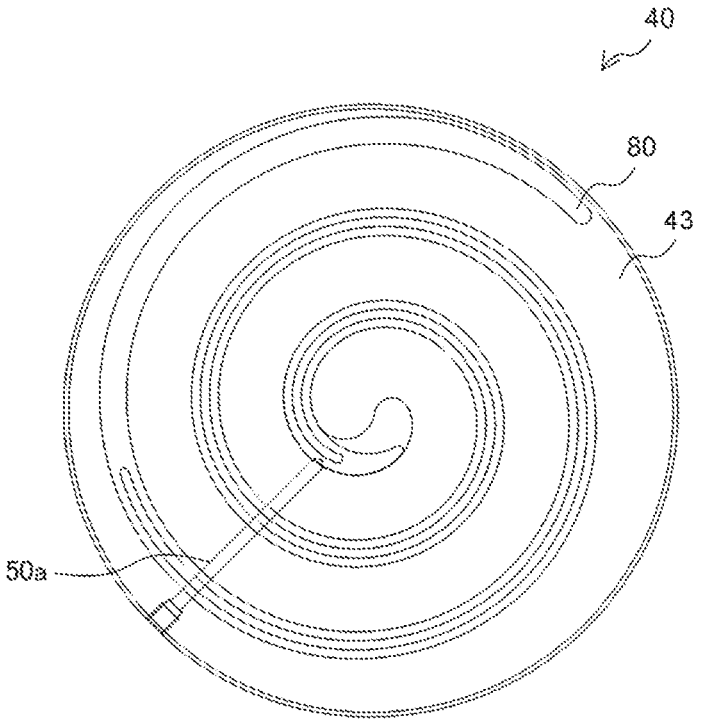
FIG. 5 is a top view of the orbiting scroll according to Embodiment 1.

FIG. 5 is a top view of the orbiting scroll 40 according to Embodiment 1. As illustrated in FIG. 5, the first hole 50*a* of the supply hole 50 is formed such that the first hole 50*a* and an outer end 80 of the orbiting scroll lap 41 are located symmetrical with respect to the center of the orbiting scroll 40.

The thrust plate 46 is a plate-like member that is provided between the frame 6 and the thrust surface 40*a* of the orbiting scroll 40. The thrust plate 46 improves the sliding characteristic of the thrust surface 40*a* when the orbiting scroll 40 revolves relative to the frame 6. Thus, the orbiting scroll 40 is supported in the axial direction by the frame 6 via the thrust plate 46.

Figure 6:
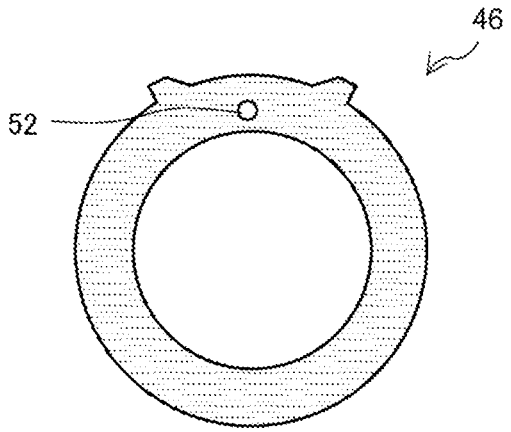
FIG. 6 is a top view of a thrust plate according to Embodiment 1.
Figure 14:
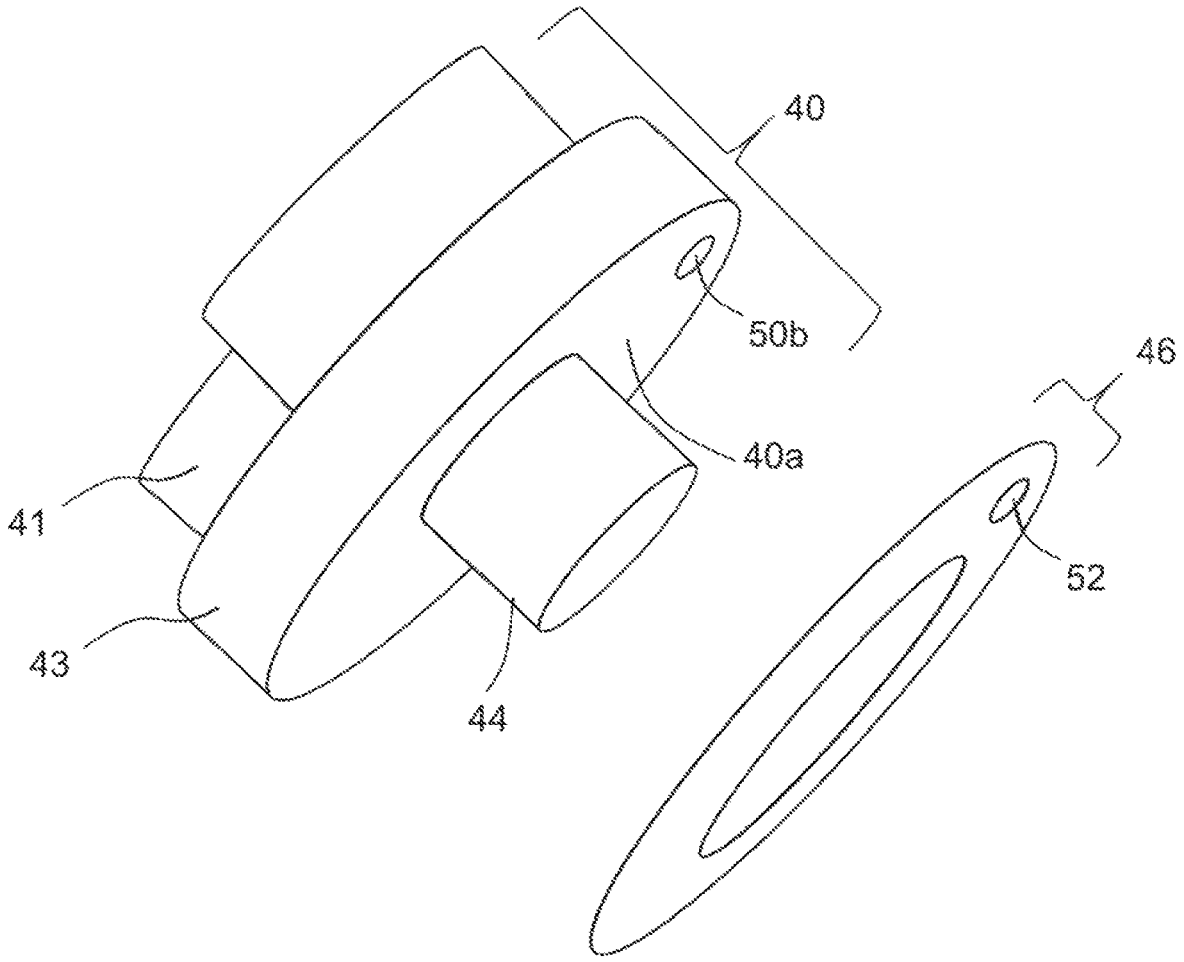
FIG. 14 is an exploded view of an orbiting scroll and a thrust plate according to Embodiment 1.

FIG. 6 is a top view of the thrust plate 46 according to Embodiment 1. FIG. 14 is an exploded view of the orbiting scroll 40 and the thrust plate 46 according to Embodiment 1. As illustrated in FIG. 6 and FIG. 14, the thrust plate 46 has an oil supply hole 52. The oil supply hole 52 is a hole that communicates with the supply hole 50 when the orbiting scroll 40 orbits. Specifically, the oil supply hole 52 is formed in such a manner as to be aligned with the second hole 50*b* of the supply hole 50 when the orbiting scroll 40 is located at a specific position while the orbiting scroll 40 makes one revolution.

Between the orbiting scroll 40 and the slider 16, an orbiting bearing 8*c* is provided. The orbiting bearing 8*c* covers the shaft 7 and the eccentric portion 45, and supports the shaft 7 such that the shaft 7 is rotatable. The eccentric portion 45 is provided at an upper end of the shaft 7 and eccentrically revolves the orbiting scroll 40. The Oldham ring 15 is provided on the thrust surface 40*a*, which is located on the opposite side of a surface of the orbiting scroll 40 on which the orbiting scroll lap 41 is formed. The Oldham ring 15 prevents the orbiting scroll 40 from rotating on its own axis while the orbiting scroll 40 is eccentrically revolving, and enables the orbiting scroll 40 to revolve. It should be noted that on an upper surface and a lower surface of the Oldham ring 15, claws (not illustrated) are provided in such a manner as to project orthogonal to each other. The claws of the Oldham ring 15 are inserted into the Oldham grooves 15*a* formed in the orbiting scroll 40 and the frame 6.

The slider 16 is a cylindrical member attached to an outer peripheral surface of the upper part of the shaft 7 and is located on an inner surface of the lower part of the orbiting scroll 40. That is, the orbiting scroll 40 is attached to the shaft 7 via the slider 16 and revolves as the shaft 7 rotates. The sleeve 17 is a cylindrical member provided between the frame 6 and the main bearing 8*a* and compensates for the inclination of the frame 6 and the shaft 7.

The first balancer 18 is attached to the shaft 7 and located between the frame 6 and a rotor 4*a*. The first balancer 18 offsets an imbalance caused by the orbiting scroll 40 and the slider 16. The first balancer 18 is accommodated in a balancer cover 18*a*. The second balancer 19 is attached to the shaft 7 and a lower surface of the rotor 4*a* and is located between the rotor 4*a* and the sub frame 20. The second balancer 19 offsets an imbalance caused by the orbiting scroll 40 and the slider 16.

The discharge valve 10 is a component that is made of a plate spring and covers the discharge port 9 to prevent backflow of a working gas. In the compression chambers 5*a*, when being compressed to a predetermined pressure, a working gas raises the discharge valve 10 against an elastic force of the discharge valve 10. Then, the compressed working gas is discharged into the high-pressure space through the discharge port 9, and discharged to the outside of the compressor 1 through the discharge pipe 12. The muffler 14 covers the discharge valve 10 and reduces pulsation of the working gas discharged through the discharge port 9.

The oil pump 3 is accommodated in the lower part of the shell 2 and draws up oil from the oil pan 13. The oil pump 3 is fixed to the lower part of the shaft 7. The oil pump 3 is, for example, a positive-displacement pump. The oil pump 3 draws oil through a pump suction port 60 that is provided in the oil pan 13, and discharges oil through a pump discharge port 61. As the shaft 7 is rotated, oil stored in the oil pan 13 is drawn up into the oil passage 7*a* formed in the shaft 7 and is supplied to the sub bearing 8*b*, the main bearing 8*a*, and the orbiting bearing 8*c* through the oil passage 7*a*. Oil with which the orbiting bearing 8*c* is lubricated passes through the first hole 50*a* of the supply hole 50 and is taken into the compression chambers 5*a*.

Figure 7:
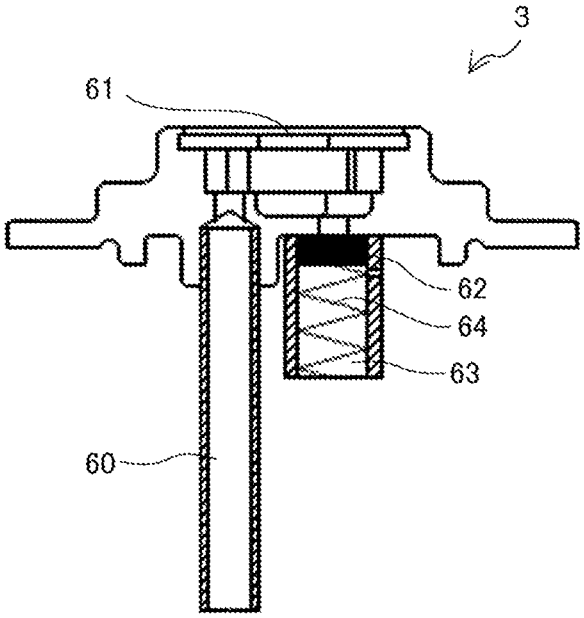
FIG. 7 is a sectional view of an oil pump according to Embodiment 1.

FIG. 7 is a sectional view of the oil pump 3 according to Embodiment 1. As illustrated in FIG. 7, the oil pump 3 includes a bypass valve 62 that is, for example, a reed valve. When the pressure of oil that flows in the oil passage 7*a* is higher than a threshold pressure, the bypass valve 62 is opened to return part of the oil to the oil pan 13. The oil pump 3 has a bypass passage 63. The bypass valve 62 is provided at an inlet of the bypass passage 63. In Embodiment 1, the oil pump 3 further includes a spring 64 that is provided in the bypass passage 63 and that is configured to move the bypass valve 62 in a direction in which the bypass valve 62 is closed.

At normal times, the bypass passage 63 is closed by the bypass valve 62. When the pressure of oil in the oil passage 7*a* is higher than the threshold pressure, the bypass valve 62 is pushed against an urging force of the spring 64 to open the bypass passage 63. As a result, oil returns to the oil pan 13 through the bypass passage 63. In the case where the bypass valve 62 is in the closed state, the volume ratio of the oil pump 3 is two or more times higher than that in the case where the bypass valve 62 is in the opened state. It is therefore possible to ensure that a sufficient amount of oil is returned to the oil pan 13 when the bypass valve 62 is in the opened state.

The oil discharge pipe 21 is a pipe through which the space between the frame 6 and the orbiting scroll 40 communicates with the space between the frame 6 and the sub frame 20, Of oil that flows in the space between the frame 6 and the orbiting scroll 40, surplus oil flows, through the oil discharge pipe 21, into the space between the frame 6 and the sub frame 20. The oil that has flowed out into the space between the frame 6 and the sub frame 20 returns to the oil pan 13 through the sub frame 20.

For example, in the shell 2, for example, between the frame 6 and the sub frame 20, the motor 4 is provided in a low-pressure space into which a working gas is sucked and that is located at the low-pressure side. The motor 4 drives the orbiting scroll 40, which is included in the compression unit 5. To be more specific, when the motor 4 drives the orbiting scroll 40 to revolve the orbiting scroll 40 via the shaft 7, a working gas is compressed in the compression unit 5. The motor 4 includes the rotor 4*a* and a stator 4*b*. The rotor 4*a* is provided close to the inner periphery of the stator 4*b*. The rotor 4*a* is driven to rotate when the stator 4*b* is supplied with electricity from an inverter (not illustrated), and the rotor 4*a* is driven to rotate, and the shaft 7 is rotated. The rotor 4*a* is fixed to an outer periphery of the shaft 7, and is held apart from the stator 4*b* by a slight distance.

Next, the operation of the compressor 1 will be described. When electricity is supplied to the stator 4*b*, the rotor 4*a* produces torque, thereby rotating the shaft 7 supported by the main bearing 8*a* provided at the frame 6 and the sub bearing 8*b* provided at the sub frame 20. The orbiting scroll 40 including the boss 44, which is attached to the eccentric portion 45 provided at the shaft 7 and which is configured to revolve, is revolved, and prevented by the Oldham ring 15 from rotating on its own axis.

That is, the boss 44 of the orbiting scroll 40 is eccentrically moved by the eccentric portion 45 of the shaft 7 while being prevented from rotating on its own axis by the Oldham ring 15, which is configured to reciprocate in a direction along the Oldham grooves 15*a* formed in the frame 6. When the boss 44 is eccentrically moved in the above state, an orbiting school makes an orbital motion, thereby changing the volumes of the compression chambers 5*a* formed between the fixed scroll lap 30*b* of the fixed scroll 30 and the scroll lap of the orbiting scroll 40. The first balancer 18 attached to the shaft 7 and the second balancer 19 attached to the rotor 4*a* perform control to compensate for an imbalance caused by movement of the orbiting scroll 40 and the Oldham ring 15.

Next, the flow of a working gas in the compressor 1 will be described. A fluid working gas is sucked from the outside of the compressor 1 into the shell 2 through the suction pipe 11. First, the working gas flows into the space between the frame 6 and the motor 4. Then, the working gas that has flowed into the space between the frame 6 and the motor 4 flows into the compression unit 5 through the suction port formed in the frame 6. The working gas that has flowed into the compression unit 5 is compressed in the compression chambers 5*a* of the compression unit 5. The compressed working gas is discharged from the fixed scroll 30 and is made to flow into a discharge space. Subsequently, after flowing out from the discharge space, the working gas passes through the muffler 14 and is discharged, through the discharge pipe 12, to the outside of the compressor 1, that is, into the refrigerant pipes 70*a* of the refrigerant circuit 70.

Next, the flow of oil in the compressor 1 will be described. Oil drawn from an oil pan 3*a* by the oil pump 3 flows into the oil passage 7*a* formed in the shaft 7. Part of the oil that has flowed into the oil passage 7*a* passes through a passage formed in the radial direction, and lubricates the sub bearing 8*b*. Then, the oil that has lubricated the sub bearing 8*b* returns to the oil pan 3*a* through the sub frame 20.

In addition, other part of the oil that has flowed into the oil passage 7*a* passes through a passage formed in the radial direction, and lubricates the main bearing 8*a*. The oil that has lubricated the main bearing 8*a* flows into the space between the frame 6 and the motor 4. The oil that has flowed into the space between the frame 6 and the motor 4 flows into the space between the frame 6 and the motor 4 through the space between the rotor 4*a* and the stator 4*b*, and returns to the oil pan 3*a* through the sub frame 20.

Furthermore, part of the oil that has flowed into the oil passage 7*a* reaches upper end part of the shaft 7, and lubricates the orbiting bearing 8*c*. The oil that has lubricated the orbiting bearing 8*c* flows into the space between the frame 6 and the orbiting scroll 40. Then, the oil that has flowed Mil into the space between the frame 6 and the orbiting scroll 40 lubricates the Oldham ring 15. Then, the oil that has lubricated the Oldham ring 15 and the oil that flows into the space between the frame 6 and the orbiting scroll 40 flow into the oil discharge pipe 21. The oil that has flowed into the oil discharge pipe 21 flows into the space between the frame 6 and the sub frame 20 and returns to the oil pan 3*a* through the sub frame 20.

It should be noted that part of the oil that has flowed into the oil passage 7*a* and has reached the upper end portion of the shaft 7 flows into the first hole 50*a* of the supply hole 50, then reaches the thrust surface 40*a* through the second hole 50*b*, and lubricates the thrust surface 40*a*. While the orbiting scroll 40 is orbiting, when the second hole 50*b* and the oil supply hole 52 do not communicate with each other, oil remains in the second hole 50*b*. By contrast, while the orbiting scroll 40 is orbiting, when the second hole 50*b* and the oil supply hole 52 communicate with each other, oil reaches the oil discharge pipe 21 through the oil supply hole 52 and is let out from the oil discharge pipe 21.

In addition, when the pressure of oil that flows in the oil passage 7*a* is higher than the threshold pressure, the bypass valve 62 of the oil pump 3 is opened, and part of the oil returns to the oil pan 13 through the bypass passage 63.

According to Embodiment 1, the oil pump 3 includes the bypass valve 62, which is opened to return part of the oil to the oil pan 13 when the pressure of oil that flows in the oil passage 7*a* is higher than the threshold pressure. The bypass valve 62 of the oil pump 3 is opened when the pressure of oil that flows in the oil passage 7*a* in a high-speed operation in which the rotation speed of the compression unit 5 is high is raised to a high value. As a result, part of the oil is returned to the oil pan 13. It is therefore possible to reduce an increase in the amount of oil supply in the high-speed operation of the compression unit 5. Accordingly, the compressor 1 is capable of reducing an increase in oil loss.

In existing scroll compressors using a positive-displacement pump whose volume is constant, bearings and a compression unit may be worn because of reduction in the amount of oil supply in a low-speed operation in which the rotation speed is low. Thus, in the existing scroll compressors, it is hard to ensure reliability. By contrast, in Embodiment 1, since the oil pump 3 includes the bypass valve 62, it is possible to reduce an increase in the amount of oil supply in the high-speed operation of the compression unit 5. Therefore, it is possible to use the oil pump 3, which has a larger volume than an existing oil pump, and thus to increase the amount of oil supply in the low-speed operation.

The compression unit 5 includes the fixed scroll 30, which is fixed in the shell 2, and the compression chambers 5*a*, which are connected to the upper end part of the shaft 7 and which are configured to compress a working gas in conjunction with the fixed scroll 30. The compression unit 5 further includes the orbiting scroll 40, which has the thrust surface 40*a* as its lower surface, and the thrust plate 46, which is provided at the thrust surface 40*a* of the orbiting scroll 40. The orbiting scroll 40 has the supply hole 50, through which the oil passage 7*a* and the thrust surface 40*a* communicate with each other, and through which oil flowing in the oil passage 7*a* is supplied to the thrust surface 40*a*. The thrust plate 46 has the oil supply hole 52, which communicates with the supply hole 50 when the orbiting scroll 40 orbits. Part of the oil that has flowed into the oil passage 7*a* and that has reached the upper end part of the shaft 7 enters the first hole 50*a* of the supply hole 50, then reaches the thrust surface 40*a* through the second hole 50*b*, and lubricates the thrust surface 40*a*.

While the orbiting scroll 40 is orbiting, when the second hole 50*b* and the oil supply hole 52 do not communicate with each other, oil remains in the second hole 50*b*. Therefore, the amount of oil that flows in the oil passage 7*a* is not reduced, and the pressure of oil that flows in the oil passage 7*a* is raised to a high value. As a result, the bypass valve 62 of the oil pump 3 is opened, and part of the oil is returned to the oil pan 13. By contrast, while the orbiting scroll 40 is orbiting, when the second hole 50*b* and the oil supply hole 52 communicate with each other, oil flows to the compression unit 5 through the oil supply hole 52 or reaches the oil discharge pipe 21 and is discharged therethrough. In this case, the pressure of oil that flows in the oil passage 7*a* is not increased, and the bypass valve 62 of the oil pump 3 is closed. When the bypass valve 62 is closed, the amount of oil drawn by the oil pump 3 is constant regardless of the rotation speed of the compression unit 5.

It should be noted the time during which the second hole 50*b* and the oil supply hole 52 communicates with each other while the orbiting scroll 40 is making one revolution in the high-speed operation in which the rotation speed of the compression unit 5 is high is shorter than that in the low-speed operation. Thus, in the high-speed operation, oil is hard to discharge, as compared with the low-speed operation. Therefore, the pressure of oil that flows in the oil passage 7*a* is raised to a high value, and the bypass valve 62 of the oil pump 3 is opened. Thus, part of the oil is returned to the oil pan 13. Accordingly, it is possible to reduce an increase in the amount of oil supply in the high-speed operation of the compression unit 5. Therefore, the compressor 1 is capable of reducing an increase in oil loss.

The orbiting scroll 40 includes the orbiting scroll lap 41, which is formed in such a manner as to spiral outward from the center of the orbiting scroll 40. The second hole 50*b* is formed such that the second hole 50*b* and the outer end 80 of the orbiting scroll lap 41 are located symmetrical with respect to the center point of the orbiting scroll 40. In the case where a bending stress acts on the base plate 43 of the orbiting scroll 40 during the operation of the compressor 1, the outer end 80 of the orbiting scroll lap 41 is most unlikely to be deformed because the outer end 80 is located at the outermost periphery of the base plate 43. By contrast, in the case where part of the orbiting scroll 40 and the outer end 80 are located symmetrical with respect to the center point, the part of the orbiting scroll 40 is most likely deformed. This may cause seizure between the orbiting scroll 40 and the thrust plate 46. In Embodiment 1, the second hole 50*b* is formed such that the second hole 50*b* and the outer end 80 are located symmetrical with respect to the center point, and oil is thus sequentially discharged from the position of the outer end 80. As a result, it is possible to improve the sliding characteristic of the part that is most likely deformed.

Embodiment 2

Figure 8:
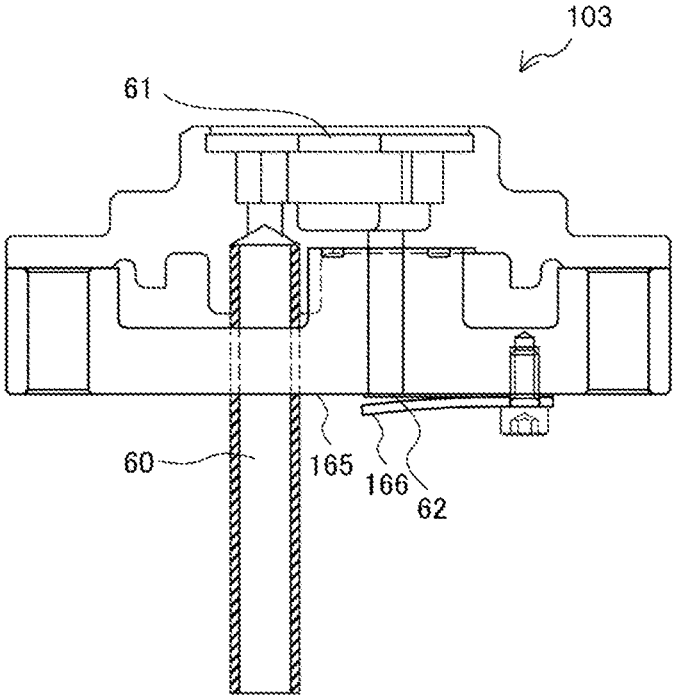
FIG. 8 is a sectional view of an oil pump according to Embodiment 2.
Figure 9:
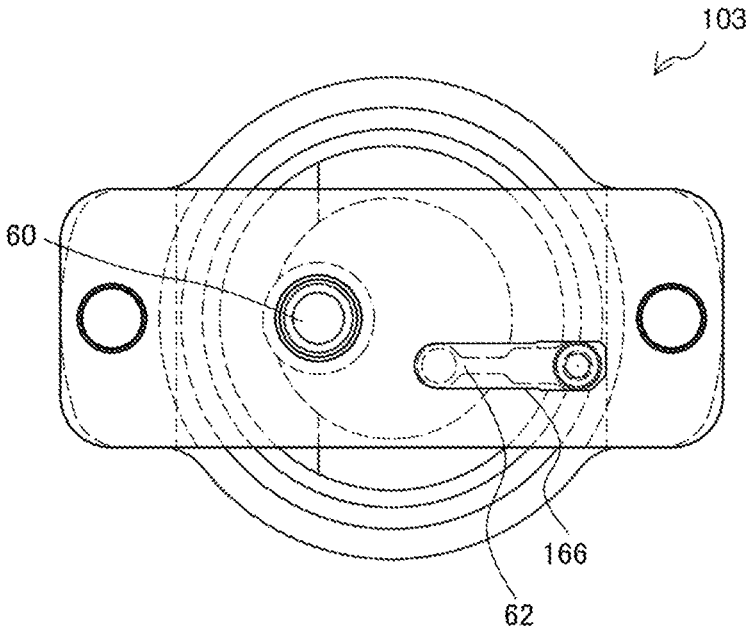
FIG. 9 is a top view of the oil pump according to Embodiment 2.

FIG. 8 is a sectional view of an oil pump 103 according to Embodiment 2. FIG. 9 is a top view of the oil pump 103 according to Embodiment 2. In Embodiment 2 the oil pump 103 includes a valve retainer 166 but does not include the spring 64. In this regard, Embodiment 2 is different from Embodiment 1. Regarding Embodiment 2, components and parts that are the same as those in Embodiment 1 will be denoted by the same reference signs, and their descriptions will be omitted. Embodiment 2 will be described by referring mainly to the differences between Embodiments 1 and 2.

As illustrated in FIGS. 8 and 9, a lower surface of the oil pump 3 is a valve seat 165 at which the bypass valve 62 is provided. The valve retainer 166 holds the bypass valve 62. At normal times, the bypass valve 62 is held and closed by the valve retainer 166. However, when the pressure of oil in the oil passage 7*a* is higher than the threshold pressure, the bypass valve 62 is pushed against a pressing force of the valve retainer 166 and is thus opened. In such a manner, in Embodiment 2, the bypass valve 62 is opened even by a relatively small load. In Embodiment 2, the bypass valve 62 is held by the valve retainer 166. However, in Embodiment 2 having the above configuration, it is also possible to obtain similar advantages to those in Embodiment 1.

Embodiment 3

Figure 10:
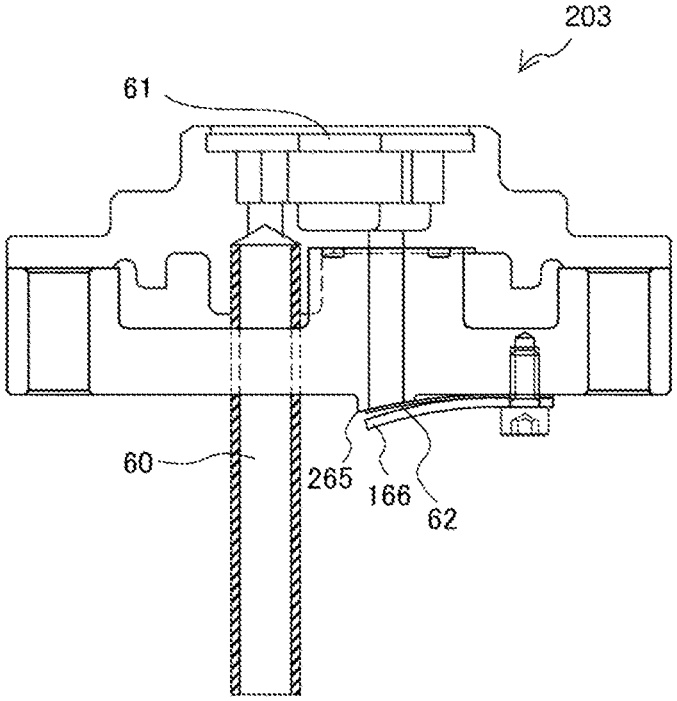
FIG. 10 is a sectional view of an oil pump according to Embodiment 3.
Figure 11:
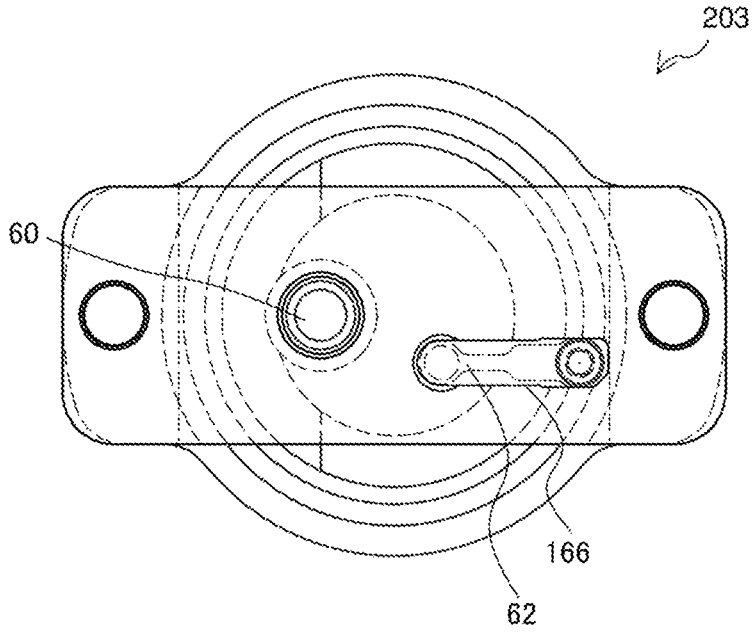
FIG. 11 is a top view of the oil pump according to Embodiment 3.

FIG. 10 is a sectional view of an oil pump 203 according to Embodiment 3. FIG. 11 is a top view of the oil pump 203 according to Embodiment 3. In Embodiment 3, a valve seat 265 is inclined. In this regard, Embodiment 3 is different from Embodiment 2. In Embodiment 3, components and parts that are the same as those in Embodiment 1 and/or Embodiment 2 will be denoted by the same reference signs, and their descriptions will thus be omitted. Embodiment 3 will be described by referring mainly to the differences between Embodiments 1 and 2 and Embodiment 3.

As illustrated in FIGS. 10 and 11, the valve seat 265 is inclined. The bypass valve 62 is provided on the inclined valve seat 265. In this case, since the valve seat 265 is inclined, the bypass valve 62 itself is inclined. Thus, the load required to open the bypass valve 62 is large. To be more specific, a pre-load is applied in a direction from the bypass valve 62 to the valve seat 265 by a restoring force of the bypass valve 62. Thus, the bypass valve 62 is not opened unless a load larger than the pre-load is applied thereto. In Embodiment 3 in which the valve seat 265 is inclined, it is also possible to obtain similar advantages as those in each of Embodiments 1 and 2.

Embodiment 4

Figure 12:
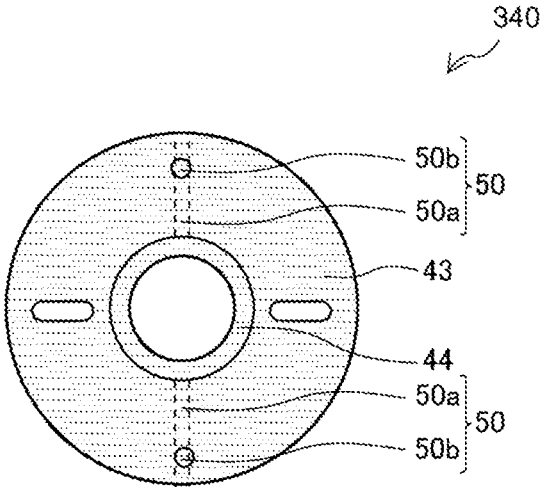
FIG. 12 is a bottom view of an orbiting scroll according to Embodiment 4.
Figure 13:
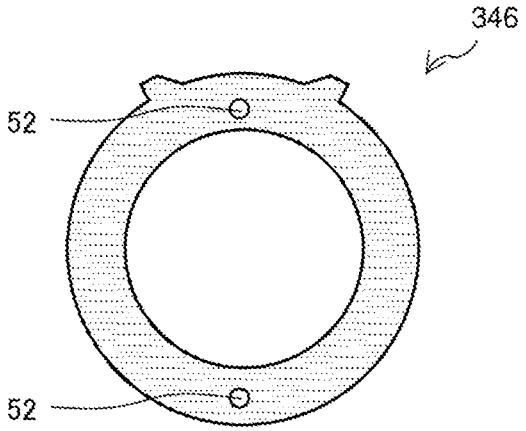
FIG. 13 is a top view of a thrust plate according to Embodiment 4.

FIG. 12 is a bottom view of an orbiting scroll 340 according to Embodiment 4. FIG. 13 is a top view of a thrust plate 346 according to Embodiment 4. In Embodiment 4, a plurality of supply holes 50 and a plurality of oil supply holes 52 are formed. In this regard, Embodiment 4 is different from Embodiment 1. Regarding Embodiment 4, components and parts that are the same as those in any of Embodiments 1 to 3 will be denoted by the same reference signs, and their descriptions will thus be omitted. Embodiment 4 will be described by referring mainly to the differences between Embodiment 4 and Embodiments 1 to 3.

As illustrated in FIG. 12, the orbiting scroll 340 has two supply holes 50. The two supply holes 50 are disposed on a line segment passing through the center of the orbiting scroll 340 and symmetrical with respect to the center point of the orbiting scroll 340. The orbiting scroll 340 may have three or more supply holes 50.

As illustrated in FIG. 13, the thrust plate 346 has two oil supply holes 52. The two oil supply holes 52 are disposed on a line segment passing through the center of the thrust plate 346 and symmetrical with respect to the center point of the thrust plate 346. The thrust plate 346 may have three or more oil supply holes 52.

In Embodiment 4, since the two supply holes 50 and the two oil supply holes 52 are formed, the total area of oil discharge passages is increased, thereby increasing the amount of oil that reaches the compression unit 5 after being discharged through the oil supply holes 52 in the low-speed operation, in which the time during which the second holes 50*b* and the oil supply holes 52 communicate with each other while the orbiting scroll 340 makes one revolution is long. By contrast, in the high-speed operation, in which the time during which the second holes 50*b* and the oil supply holes 52 communicate with each other while the orbiting scroll 340 makes one revolution is short, oil is not discharged through the oil supply holes 52 and the pressure of oil in the oil passage 7*a* is raised to a high value. Thus, the bypass valve 62 of the oil pump 3 is opened, and part of the oil is returned to the oil pan 13. In such a manner, compared with Embodiment 4, the amount of oil that is supplied in the low-speed operation of the compressor 1 is increased, and the amount of oil that is supplied in the high-speed operation of the compressor 1 is decreased. It should be noted that since the amount of oil discharged from the orbiting scroll 340 is increased, the sliding characteristic of each of sliding portions is improved.

The configurations described above regarding Embodiments 1 to 4 can be changed as appropriate.

REFERENCE SIGNS LIST

1: compressor, 2: shell, 2*a*: upper shell, 2*b*: lower shell, 3: oil pump, 13: oil pan, 4: motor, 4*a*: rotor, 4*b*: stator, 5: compression unit, 5*a*: compression chamber, 6: frame, 7: shaft, 7*a*: oil passage, 8*a*: main bearing, 8*b*: sub bearing, 8*c*: orbiting bearing, 9: discharge port, 10: discharge valve, 11: suction pipe; 12: discharge pipe, 14: muffler, 15: Oldham ring, 15*a*: Oldham groove, 16: slider, 17: sleeve, 18: first balancer, 18*a*: balancer cover, 19: second balancer, 20: sub frame, 21: oil discharge pipe, 30: fixed scroll, 30*a*: panel, 30*b*: fixed scroll lap, 40: orbiting scroll, 40*a*: thrust surface, 41: orbiting scroll lap, 43: base plate, 44: boss, 45: eccentric portion, 46: thrust plate, 50: supply hole, 50*a*: first hole, 50*b*: second hole, 51: set screw, 52: oil supply hole, 60: pump suction port, 61: pump discharge port, 62: bypass valve, 63: bypass passage, 64: spring, 70: refrigerant circuit, 70*a*: refrigerant pipe, 72: flow switching device, 73: outdoor heat exchanger, 74: outdoor fan, 75: expansion unit, 76: indoor heat exchanger, 77: indoor fan, 80: outer end, 100: air-conditioning apparatus, 101: outdoor unit, 102: indoor unit, 103: oil pump, 165: valve seat, 166: valve retainer, 203: oil pump, 265: valve seat, 340: orbiting scroll, 346: thrust plate

The invention claimed is:

1. A compressor comprising:

a shell forming an outer portion of the compressor and having lower part in which an oil pan is formed, the oil pan being configured to store oil;

a motor provided in the shell;

a compression unit provided in the shell and configured to compress a working gas when being driven by the motor;

a frame fixed to the shell and supporting the compression unit;

a shaft supported by the frame and connecting the motor and the compression unit, the shaft being configured to transmit a turning force of the motor to the compression unit, and including an oil passage through which oil flows; and an oil pump provided at lower part of the shaft, and configured to draw oil from the oil pan and supply the oil into the oil passage, the oil pump including a bypass valve configured to be opened, when a pressure of oil flowing in the oil passage is higher than a threshold pressure, to return part of the oil to the oil pan, wherein the compression unit includes a fixed scroll fixed in the shell, an orbiting scroll including a boss to which upper end part of the shaft is connected, and forming a compression chamber configured to compress along with the fixed scroll, the working gas, the orbiting scroll having a thrust surface that is formed as a lower surface of the orbiting scroll, and a thrust plate contacting the thrust surface of the orbiting scroll, the orbiting scroll has a supply hole that connects the oil passage and the thrust surface and that is used to supply oil flowing in the oil passage to the thrust surface, and the thrust plate has an oil supply hole that communicates with the supply hole when the orbiting scroll orbits, wherein the supply hole of the orbiting scroll includes a first hole extending laterally from the oil passage, and a second hole extending downward from the first hole, the second hole connecting the first hole and the thrust surface, when the orbiting scroll orbits, the second hole and the oil supply hole are intermittently communicated, a time during which the second hole and the oil supply hole communicate is shorter during high speed operation than during low speed operation, and when the time during which the second hole and the oil supply hole communicate with each other during high speed operation is shorter, the pressure of the oil flowing into the oil passage increases and the bypass valve of the oil pump is opened by the pressure of the oil exceeding the pressure threshold.

2. The compressor of claim 1, wherein the orbiting scroll includes an orbiting scroll lap that spirals outward from a center of the orbiting scroll lap, and the second hole is formed such that the second bole and an outer end of the orbiting scroll lap are located on opposite sides of the orbiting scroll such that the second hole, the outer end of the orbiting scroll lap, and a center point of the orbiting scroll are linearly arranged.

3. The compressor of claim 1, wherein the orbiting scroll has a plurality of supply holes, and the thrust plate has a plurality of oil supply holes.

4. The compressor of claim 1, wherein a volume ratio of the oil pump when the bypass valve is in a closed state is two or more times higher than a volume ratio of the oil pump when the bypass valve is in an opened state.

5. The compressor of claim 1, wherein the oil pump further includes a spring configured to move the bypass valve in a direction in which the bypass valve is closed.

6. The compressor of claim 1, wherein the oil pump further includes a valve retainer configured to hold the bypass valve.

7. The compressor of claim 6, wherein the oil pump further includes a valve seat on which the bypass valve is provided, the valve seat being inclined.

* * * * *